US011820551B2

(12) United States Patent
Feiner

(10) Patent No.: US 11,820,551 B2
(45) Date of Patent: Nov. 21, 2023

(54) NESTABLE PALLET

(71) Applicant: Digipal Solutions Israel Ltd., Ramat Hasharon (IL)

(72) Inventor: Gideon Feiner, Ramat Hasharon (IL)

(73) Assignee: DIGIPAL SOLUTIONS ISRAEL LTD., Ramat Hasharon (IL)

( * ) Notice: Subject to any disclaimer, the term of this patent is extended or adjusted under 35 U.S.C. 154(b) by 9 days.

(21) Appl. No.: 17/542,431

(22) Filed: Dec. 5, 2021

(65) Prior Publication Data

US 2023/0174271 A1 Jun. 8, 2023

(51) Int. Cl.
*B65D 19/38* (2006.01)

(52) U.S. Cl.
CPC ..... *B65D 19/38* (2013.01); *B65D 2519/0094* (2013.01); *B65D 2519/00338* (2013.01)

(58) Field of Classification Search
CPC ..... B65D 19/38; B65D 2519/0094; B65D 2519/0096; B65D 2519/0038; B65D 19/0038; B65D 2519/00935
USPC ..... 108/53.3, 57.25
See application file for complete search history.

(56) References Cited

U.S. PATENT DOCUMENTS 3,228,358 A * 1/1966 Sepe ..... B65D 19/004 108/901
3,526,195 A * 9/1970 Maryonovich ..... B65D 19/004 108/901
3,580,190 A * 5/1971 Fowler ..... B65D 19/0012 108/57.25
4,809,618 A * 3/1989 Bell ..... B65D 19/44 108/901
5,413,052 A * 5/1995 Breezer ..... B65D 19/0012 108/57.33
5,638,760 A * 6/1997 Jordan ..... B65D 19/0018 108/57.25
5,791,262 A * 8/1998 Knight ..... B65D 19/0018 108/57.25
5,868,080 A * 2/1999 Wyler ..... B65D 19/0026 108/57.25
6,748,876 B2 * 6/2004 Preisler ..... B65D 19/0012 108/57.25
8,770,115 B2 * 7/2014 Apps ..... B65D 19/0004 108/57.25
8,950,342 B2 * 2/2015 Plattner ..... B65D 19/0016 108/57.25
2001/0029874 A1 * 10/2001 Muirhead ..... B65D 19/0012 108/57.25
2005/0211139 A1 * 9/2005 Perrotta ..... B65D 19/0038 108/57.25
2010/0043676 A1 * 2/2010 Apps ..... B65D 19/0087 108/57.25

(Continued)

*Primary Examiner* — Jose V Chen
(74) *Attorney, Agent, or Firm* — Mark M. Friedman

(57) ABSTRACT

A nestable pallet includes a deck supported by hollow legs. Each hollow leg has an upper opening for receiving part of a corresponding leg of another pallet when the pallets are stacked. A horizontal cross-sectional shape of at least one, and preferably all, of the hollow legs corresponds to the union of at least two oblong shapes intersecting orthogonally, each oblong shape having an aspect ratio greater than 2:1. The legs preferably have T-shaped or H-shaped cross-sectional shapes, and may be deployed to provide support for reinforcing beams extending through the deck.

17 Claims, 9 Drawing Sheets

(56) References Cited

U.S. PATENT DOCUMENTS

| | | | | |
|---|---|---|---|---|
| 2012/0291678 | A1* | 11/2012 | Howland | B65D 19/0018 108/51.11 |
| 2012/0304898 | A1* | 12/2012 | Dubois | B65D 19/0063 108/57.25 |
| 2012/0325125 | A1* | 12/2012 | Apps | B65D 19/0014 108/51.11 |
| 2013/0139734 | A1* | 6/2013 | Scanzillo | B65D 19/0065 108/53.3 |
| 2013/0174762 | A1* | 7/2013 | Hedley | B65D 19/40 108/57.33 |
| 2022/0289427 | A1* | 9/2022 | Coubray | B65D 19/0018 |

* cited by examiner

NESTABLE PALLET

FIELD AND BACKGROUND OF THE INVENTION

The present invention relates to pallets and, in particular, it concerns a nestable pallet with a distinctive implementation of hollow legs.

Pallets made primarily from polymer materials are known to provide numerous advantages, being robust and reusable. For compact return shipping, they are sometimes implemented with hollow tapered leg structures in order to be compactly nestable with other similar pallets.

SUMMARY OF THE INVENTION

The present invention is a nestable pallet for supporting a load above a floor.

According to the teachings of an embodiment of the present invention there is provided, a nestable pallet for supporting a load above a floor comprising: (a) a deck having an upper surface for bearing the load, a length and a width; and (b) a plurality of hollow legs integrally formed with the deck and extending downwards from the deck so as to support the deck above the floor, each of the hollow legs having an upper opening for receiving part of a corresponding leg of another pallet when a plurality of similar pallets are stacked, wherein a horizontal cross-sectional shape of at least one of the hollow legs corresponds to the union of at least two oblong shapes intersecting orthogonally, each oblong shape having an aspect ratio greater than 2:1 between an extensional direction and a transverse dimension.

According to a further feature on an embodiment of the present invention, each of the oblong shapes has its extensional directions running parallel to the length or the width.

According to a further feature on an embodiment of the present invention, the horizontal cross-sectional shape has an enclosing rectangle defined by a rectangle with sides parallel to the length and the width which fits closely to the horizontal cross-sectional shape, and wherein a largest circle that can fit inside the horizontal cross-sectional shape has an area of less than 20 percent of the enclosing rectangle.

According to a further feature on an embodiment of the present invention, the deck further comprises a set of reinforcing beams, and wherein one of the oblong shapes runs adjacent to, and with its extensional direction parallel to, a length of one of the reinforcing beams.

According to a further feature on an embodiment of the present invention, the at least one of the hollow legs is deployed between one of the reinforcing beams and an edge of the deck, and wherein the at least two oblong shapes form a T-shape horizontal cross-sectional shape with a top of the T-shape running adjacent and parallel to the reinforcing beam and a base of the T-shape extending towards the edge of the deck.

According to a further feature on an embodiment of the present invention, the T-shape is an asymmetric T-shape in which one side of the top of the T-shape extends towards another edge of the deck.

According to a further feature on an embodiment of the present invention, the at least one of the hollow legs is deployed between two of the reinforcing beams, and wherein the at least two oblong shapes are three oblong shapes forming an H-shape horizontal cross-sectional shape with each side of the H-shape running adjacent and parallel to a corresponding one of the two reinforcing beams.

According to a further feature on an embodiment of the present invention, the H-shape an asymmetric H-shape in which the sides of the H-shape extend towards an edge of the deck.

According to a further feature on an embodiment of the present invention, a floor contact surface of the hollow leg starts less than 3 percent of a length of the deck away from an end of the nestable pallet.

According to a further feature on an embodiment of the present invention, a floor contact surface of the at least one of the hollow legs spans at least 10 percent of a length of the deck.

According to a further feature on an embodiment of the present invention, a floor contact surface of the plurality of hollow legs spans more than 30 percent of a length of the deck.

According to a further feature on an embodiment of the present invention, a first of the hollow legs is located in a corner region of the deck and a second of the hollow legs is located in a medial region of a side of the deck, the first hollow leg being spaced away from edges of the deck by a clearance distance greater than a clearance distance that the second hollow leg is spaced away from an edge of the deck.

There is also provided according to an embodiment of the present invention, a nestable pallet for supporting a load above a floor comprising: (a) a deck having an upper surface for bearing the load, a length and a width, the deck including a plurality of reinforcing beams extending parallel to the length; and (b) a plurality of hollow legs integrally formed with the deck and extending downwards from the deck so as to support the deck above the floor, each of the hollow legs having an upper opening for receiving part of a corresponding leg of another pallet when a plurality of similar pallets are stacked, a first of the hollow legs having a horizontal cross-sectional shape corresponding to the union of two oblong shapes forming a T-shape horizontal cross-sectional shape, and deployed such that a top of the T-shape runs adjacent and parallel to one of the reinforcing beams and a base of the T-shape extends towards an edge of the deck, a second of the hollow legs having a horizontal cross-sectional shape corresponding to the union of three oblong shapes forming an H-shape horizontal cross-sectional shape with each side of the H-shape running adjacent and parallel to a corresponding one of the two reinforcing beams.

According to a further feature on an embodiment of the present invention, for each of the hollow legs, the horizontal cross-sectional shape has an enclosing rectangle defined by a rectangle with sides parallel to the length and the width which fits closely to the horizontal cross-sectional shape, and wherein a largest circle that can fit inside the horizontal cross-sectional shape has an area of less than 20 percent of the enclosing rectangle.

According to a further feature on an embodiment of the present invention, a floor contact surface of the hollow leg starts less than 3 percent of a length of the deck away from an end of the nestable pallet.

According to a further feature on an embodiment of the present invention, a floor contact surface of the at least one of the hollow legs spans at least 10 percent of a length of the deck.

According to a further feature on an embodiment of the present invention, a floor contact surface of the plurality of hollow legs spans more than 30 percent of a length of the deck.

According to a further feature on an embodiment of the present invention, the first hollow leg is located in a corner region of the deck and the second hollow leg is located in a medial region of a side of the deck, the first hollow leg being spaced away from edges of the deck by a clearance distance greater than a clearance distance than the second hollow leg is spaced away from an edge of the deck.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
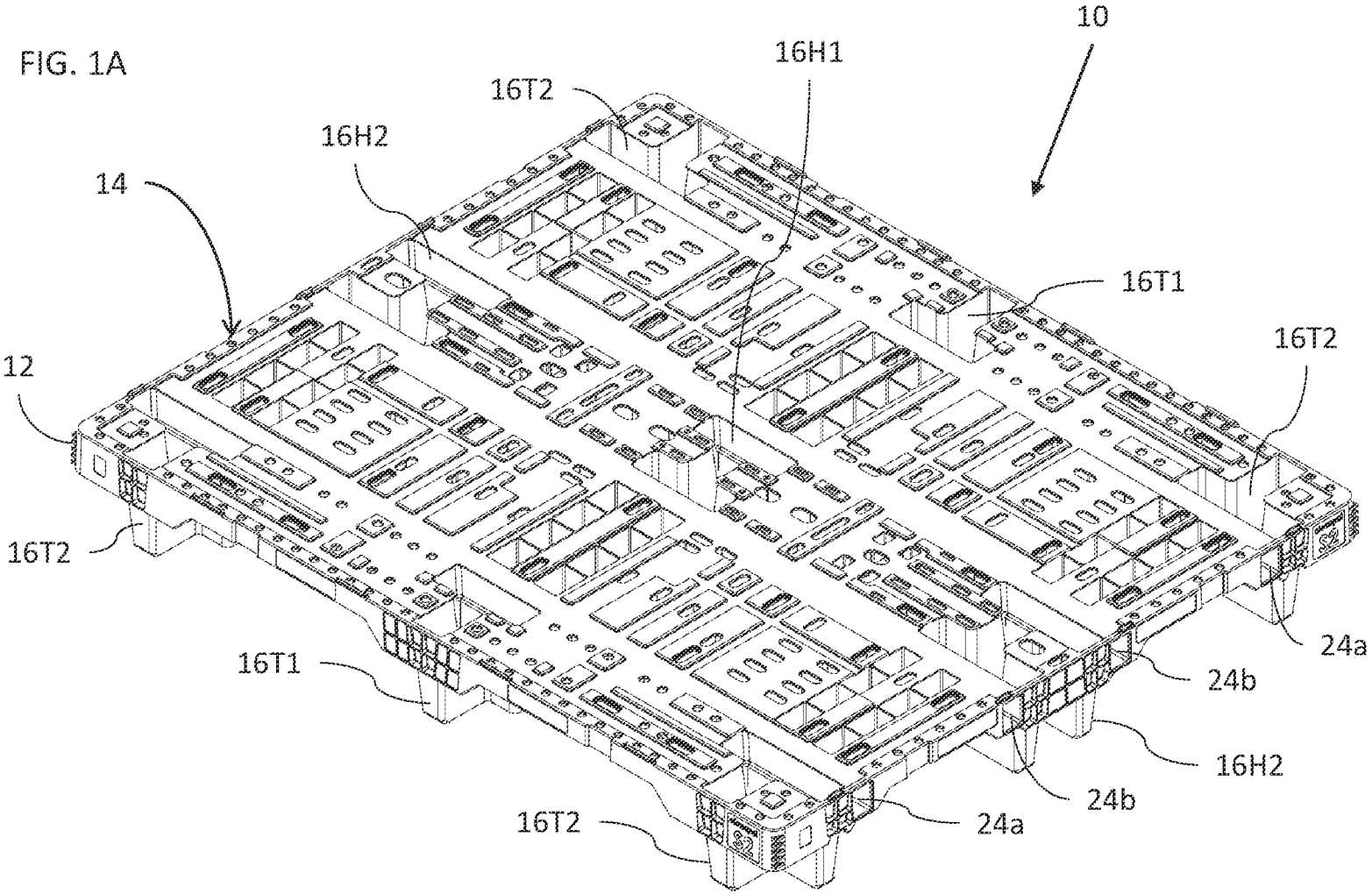
FIG. 1A is an isometric view of a nestable pallet, constructed and operative according to the teachings of an embodiment of the present invention.
Figure 1B:
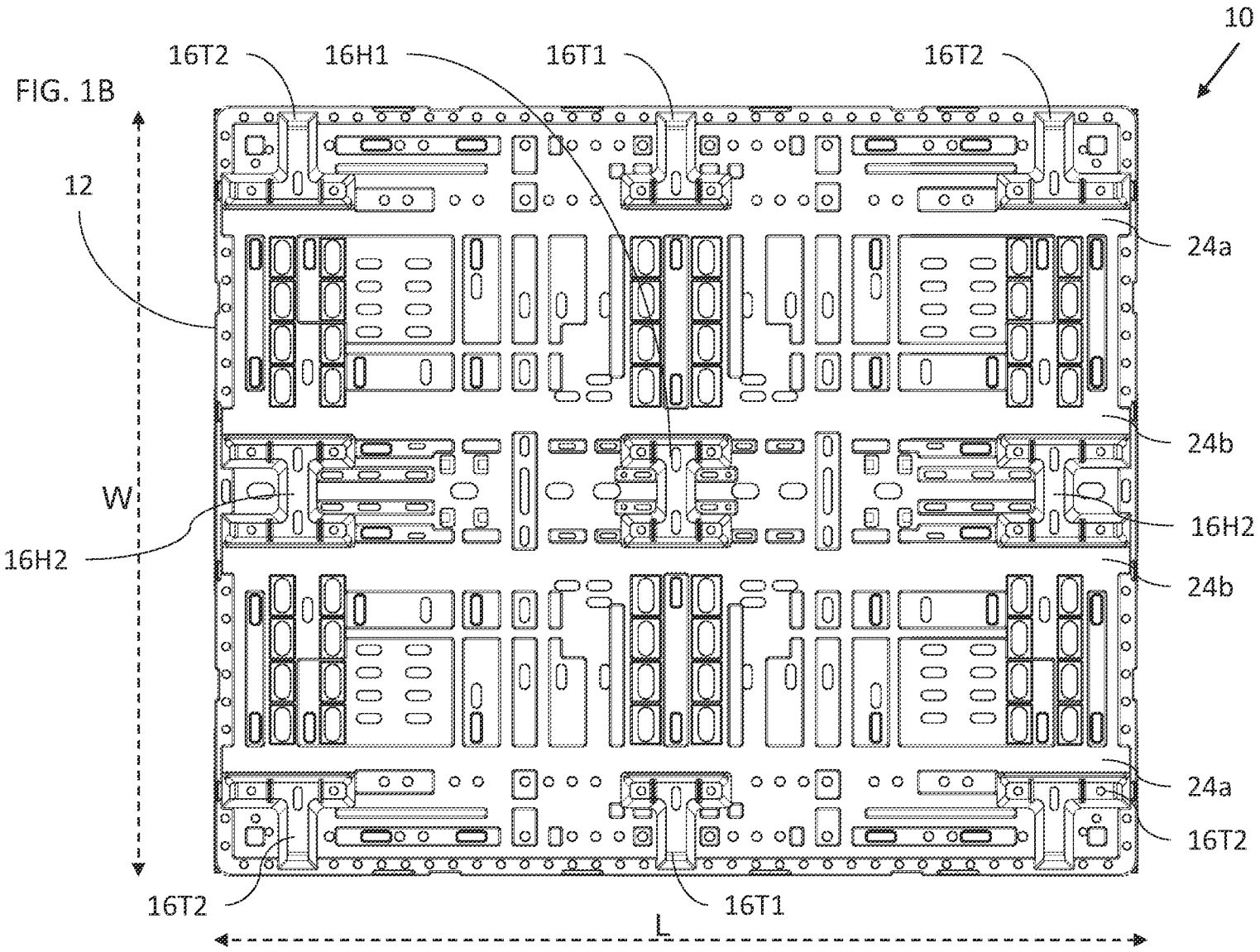
FIGS. 1B-1D are a top, side and end view of the nestable pallet of FIG. 1A.

The present invention is a nestable pallet for supporting a load above a floor.

The principles and operation of nestable pallets according to the present invention may be better understood with reference to the drawings and the accompanying description.

Referring now to the drawings, FIGS. 1A-1E illustrate a nestable pallet, generally designated 10, constructed and operative according to an embodiment of the present invention, for supporting a load above a floor. Generally speaking, pallet 10 includes a deck 12 having an upper surface 14 for bearing the load. The deck 12 (and hence also the pallet 10 as a whole) has an overall length L (the larger dimension) and a width W (the smaller dimension), as marked in FIG. 1B. Deck 10 is supported above the floor by a plurality of hollow legs 16 (labeled with an additional suffix H1, H2, T1 or T2, as will be explained further below), integrally formed with deck 12 and extending downwards from the deck. Each of the hollow legs 16 has an upper opening for receiving part of a corresponding leg of another pallet when a plurality of similar pallets are stacked.

Although nestable pallets are known to be highly advantageous for providing volume reduction for return shipping of the empty pallets, the design of nestable legs for such pallets are subject to a number of conflicting design considerations, as follows:

1. Each leg needs to be hollow from the top, and to have a vertical taper, in order to allow nesting of at least part of the length of one leg inside the hollow of the underlying pallet.
2. At the same time, in order to provide stable support for objects placed on the deck, the overall size of the opening of the hollow leg should be kept to a minimum.
3. In order to allow the pallet to be used on a roller conveyor (despite the lack of runners), the floor contact surfaces of the legs should be extended in the direction of the length of the pallet so as to pass smoothly from roller to roller.
4. In order to allow racking of the pallet, the legs need to extend to as near as possible to the edges of the pallet, and the load needs to be effectively transferred to load-bearing longitudinal support structures which support the load in the middle of the pallet length.
5. Since the outside edges of the pallet, and particularly the corners, have highest exposure to accidental impacts and damage, it is preferably to minimize the exposure of vertical walls of the legs at the edges of the pallet, and to space them away from the corners.

It will be apparent that considerations 1-3 above present an apparent conflict of design considerations: considerations 1 and 2 dictate that the upper opening of the hollow leg should be relatively small and that the hollow should taper inwards, resulting in an even smaller floor contact surface, whereas consideration 3 indicates that the floor contact surface should be increased. Similarly, considerations 4 and 5 are in dissonance, with consideration 4 requiring implementation of the legs close to the pallet ends while consideration 5 suggests minimizing edge exposure of the legs. An aspect of the present invention relates to a particular set of designs for legs 16 which are believed to exemplify an advantageous approach to balancing these different design considerations, and to provide a beneficial combination of features to address some or all of the above requirements.

Specifically, according to an aspect of the present invention as illustrated, a horizontal cross-sectional shape of at least one of the hollow legs, and most preferably all of the hollow legs, corresponds to the union of at least two oblong shapes intersecting orthogonally. The oblong shape is typically a rectangle, with or without rounded corners, and the shapes are considered to be orthogonal if their longer/major axes are orthogonal. Each oblong shape has an aspect ratio greater than 2:1 between its extensional direction (also referred to as its longer axis, major axis or longer dimension) and its transverse dimension (also referred to as its shorter or minor axis or dimension). Preferably, each oblong shape has its extensional direction running parallel (aligned) with either the length or the width of deck 12.

Figure 2:
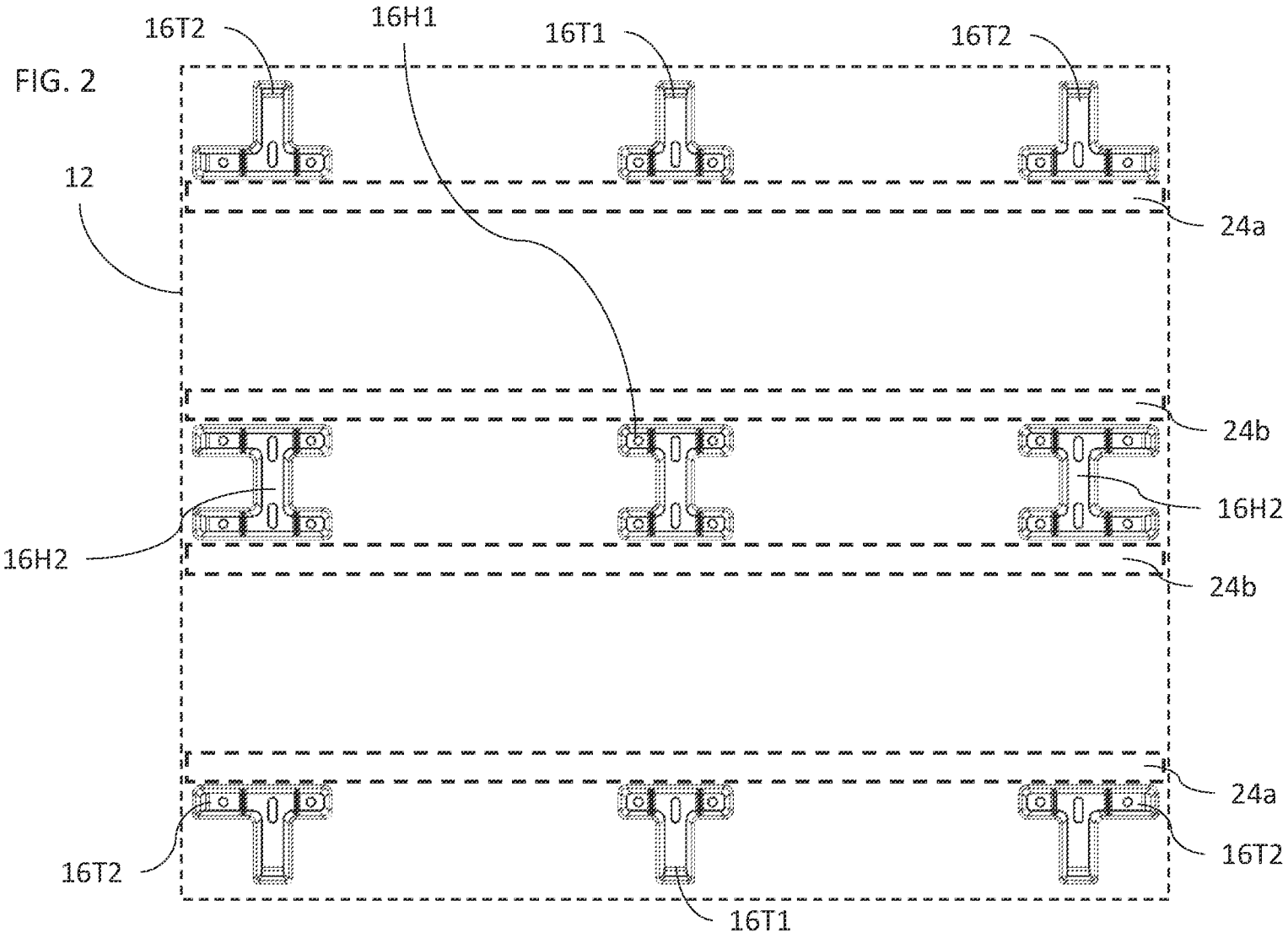
FIG. 2 is a cross-sectional view taken along line II-II in FIG. 1D so as to show only the form of the legs of the pallet, with additional dashed markings showing the position of reinforcement beams and an outline of a deck of the pallet.
Figure 3A:
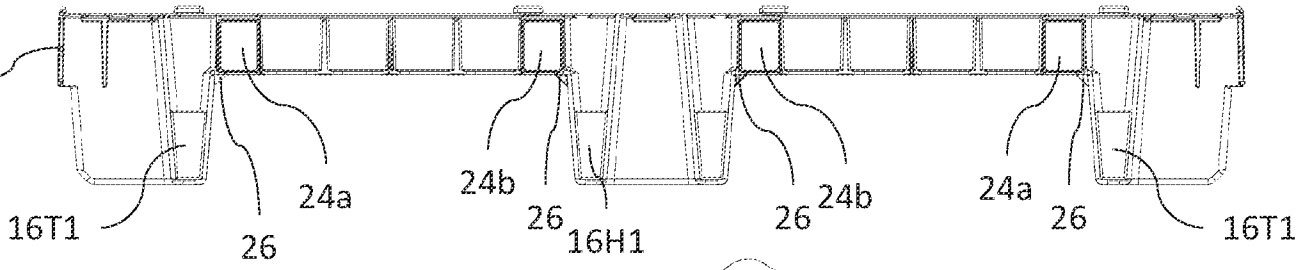
FIG. 3A is a cross-sectional view taken along line III-III in FIG. 1C.
Figure 3B:
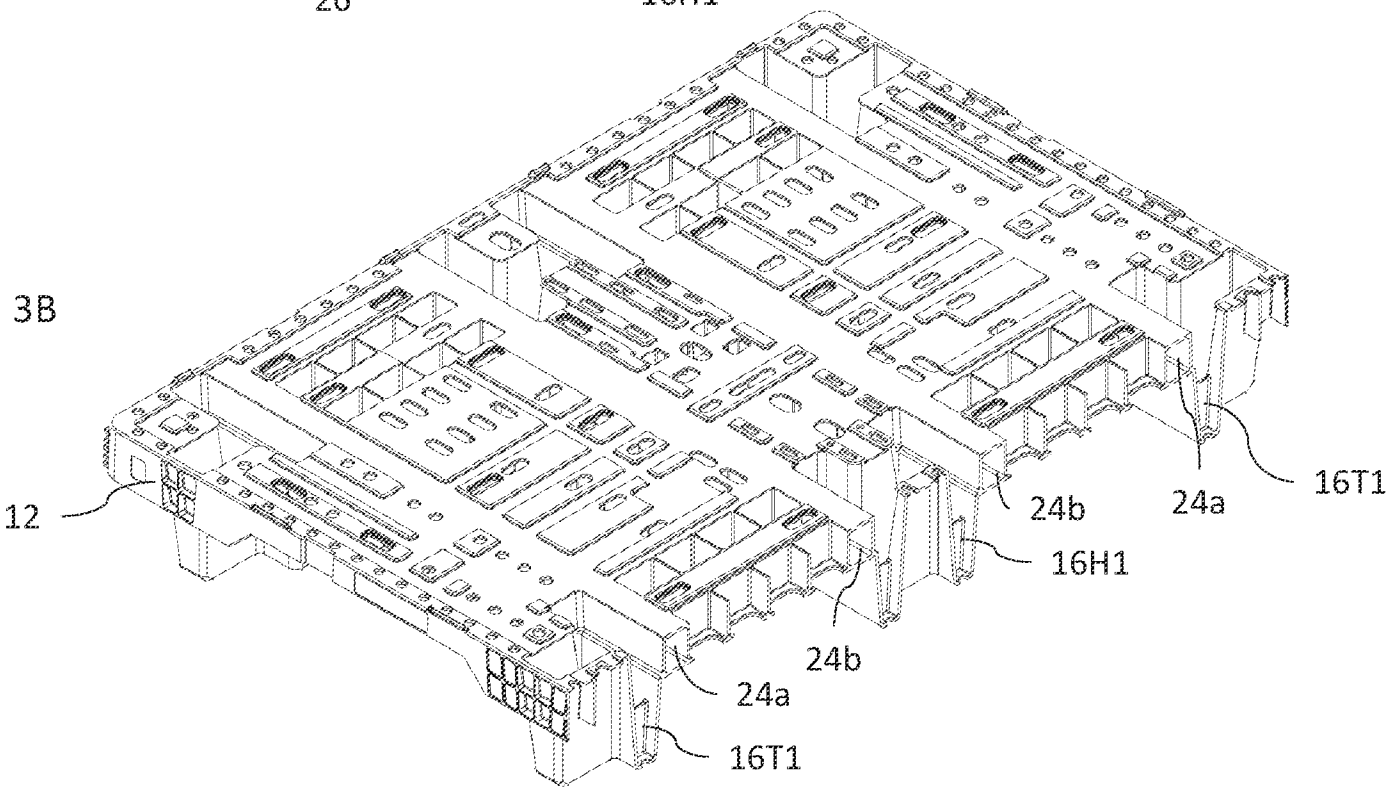
FIG. 3B is an isometric view of the pallet of FIG. 1A cut-away along the cross-section line III-III in FIG. 1C.

The cross-sectional shapes of the legs of the particularly preferred implementation illustrated here are best seen in FIG. 2, and include two subsets of shapes that are further described with reference to FIGS. 4A and 5A.

Figure 4A:
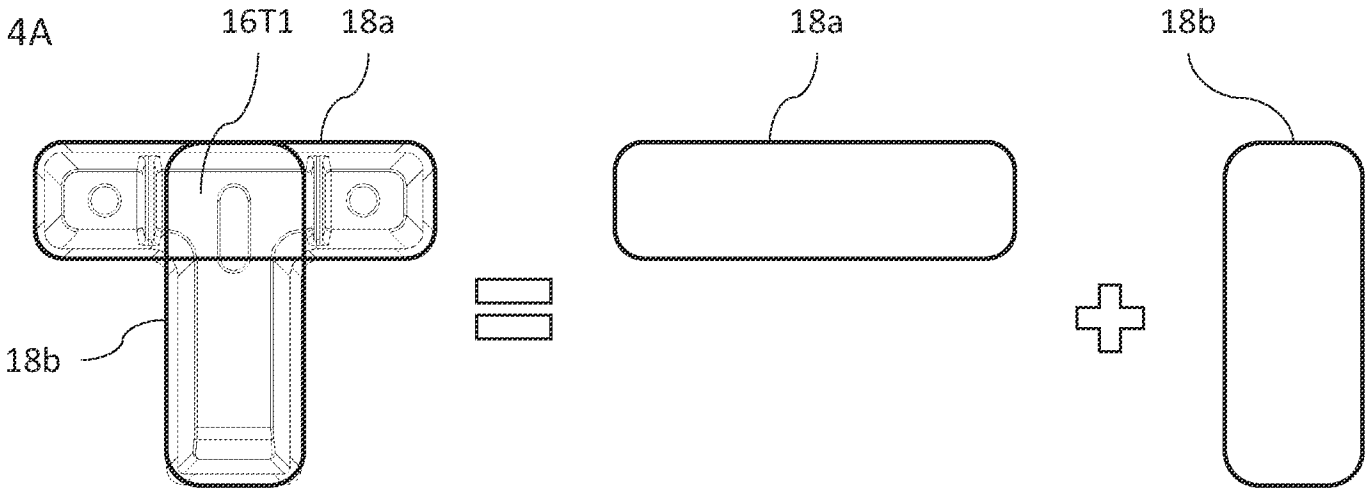
FIG. 4A is a schematic illustration showing how one of the legs illustrated in FIG. 3A has a cross-sectional shape corresponding to the union of two oblong shapes.

FIG. 4A illustrates a first subgroup of legs in which two oblong shapes 18*a* and 18*b* intersect orthogonally to form a T-shape horizontal cross-sectional shape 16T1. Both here and in the other examples illustrated herein, it should be noted that the overall shape of the leg cross-section "corresponds" to the union of the two intersecting shapes, but may be somewhat modified, such as by rounding of the intersection regions.

Figure 5A:
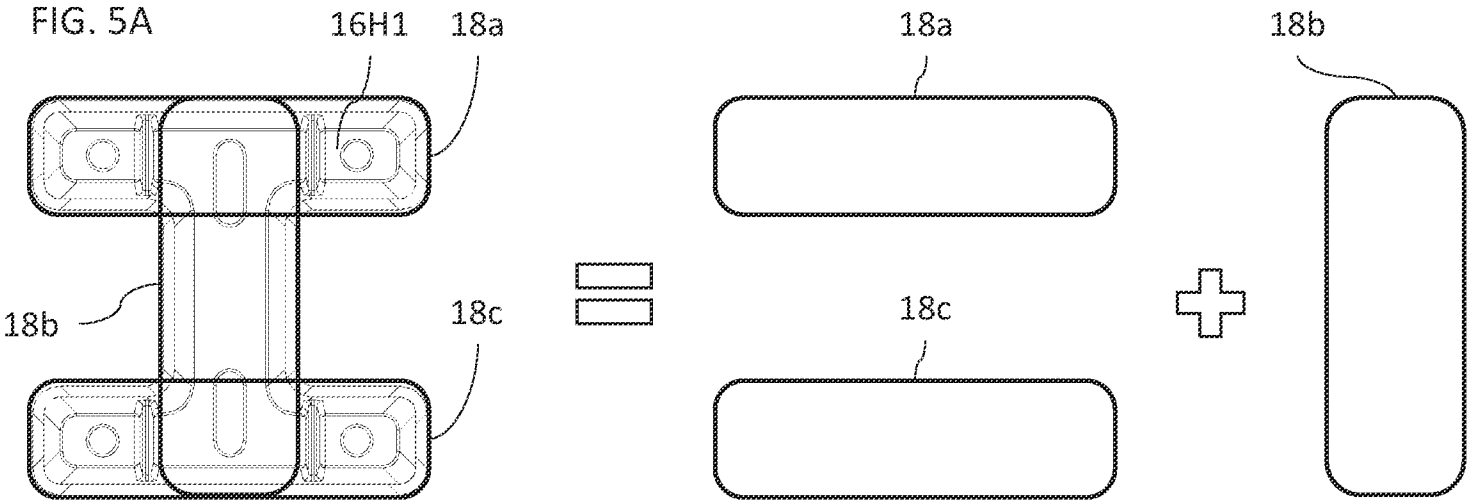
FIG. 5A is a schematic illustration showing how another one of the legs illustrated in FIG. 3A has a cross-sectional shape corresponding to the union of three oblong shapes.

FIG. 5A shows a second subgroup of legs in which three oblong shapes 18*a*, 18*b* and 18*c* intersect orthogonally to form an H-shape horizontal cross-sectional shape 16H1. Although the T-shape and the H-shape may in some cases be used interchangeably, various design considerations may favor the use of one or other of these configurations in each deployment location, as further detailed below.

Figure 4B:
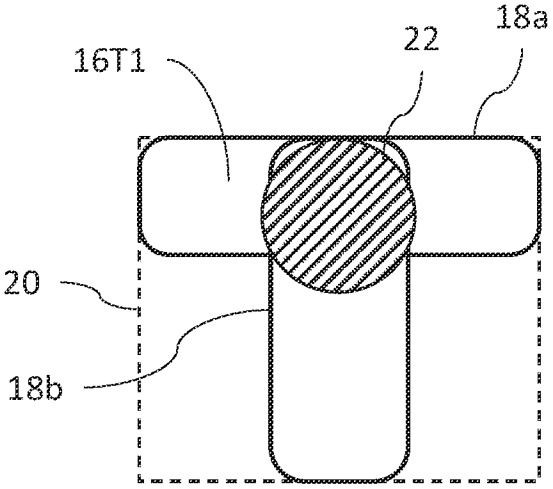
FIG. 4B is a schematic illustration of an enclosing rectangle for the cross-sectional shape of FIG. 4A and a largest circle that can fit inside the cross-sectional shape.
Figure 5B:
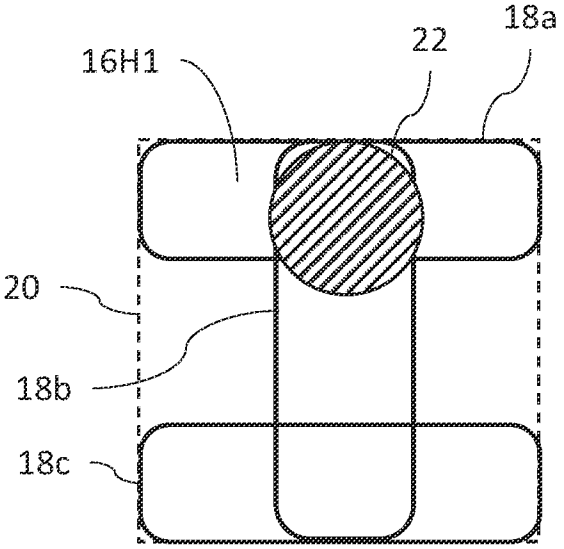
FIG. 5B is a schematic illustration of an enclosing rectangle for the cross-sectional shape of FIG. 5A and a largest circle that can fit inside the cross-sectional shape.

A leg design with a cross-sectional shape corresponding to the union of a number of oblong shapes intersecting orthogonally facilitates an improved balance between some of the design considerations listed above. Specifically, the effective footprint of the leg in either the length direction or the width direction of the deck is defined by the major axis of the corresponding oblong shape, whereas the sufficiency of support for objects on the load-bearing surface of deck 12 depends primarily on the smaller dimension of the openings. This is illustrated schematically for the T-shape and H-shape cross-section legs, respectively, in FIGS. 4B AND 5B. In each case, the horizontal cross-sectional shape is shown with an enclosing rectangle 20 defined as a rectangle with sides parallel to the length and the width which fits closely to the horizontal cross-sectional shape. This rectangle is representative of the total length and width of the pallet that is effectively spanned by the leg, and can be considered to be the effective footprint of the leg. Also shown is a circle 22 which corresponds to the largest circle that can fit inside the horizontal cross-sectional shape. Any object larger than this will sit at least partially on a boundary of the hollow leg, and will therefore be supported by the surface of the deck. Clearly, circle 22 has a much smaller area than enclosing rectangle 20, with the circle preferably having an area of less than 20 percent of the enclosing rectangle.

In order to provide pallet 10 with enhanced longitudinal strength, deck 12 preferably includes a set of reinforcing beams 24*a* and 24*b*. These beams may be reinforcements which are integrated into the polymer molding design, or may be implemented as additional beams, typically formed of steel or other metal, but optionally implemented using carbon fiber reinforced rods or other composite materials, inserted into channels prepared in deck 12. The reinforcing beams provide enhanced load bearing properties for a range of scenarios, and are particularly valuable to provide sufficient support for the central region of the pallet in the case of racking, where the central region of the pallet is unsupported. The number and positioning of the reinforcing beams may be varied according to the intended application and other design considerations. In the non-limiting example illustrated here, deck 12 includes two reinforcing beams 24*a* set in from the long edges of the crate, and a pair of reinforcing beams 24*b* in the mid-region of the width.

Ideally, the reinforcing beams would be placed immediately above the legs in order to provide optimal support for the beams when the pallet is resting on a floor surface or supported on a rack. However, the requirement of hollow legs for nesting purposes precludes deployment of the beams over the legs. In order to provide effective transfer of load between the legs and the reinforcing beams, it is a particularly preferred feature of some implementations of the present invention that one of the oblong shapes of the leg cross-section runs adjacent to, and with its extensional direction parallel to, a length of one of the reinforcing beams. This may be seen for example in FIGS. 1E and 2, where the top of the T-shape of legs 16T1 and 16T2 runs adjacent and parallel to reinforcing beam 24*a* (while the base of the T-shape extends towards the edge of the deck), and where each side of the H-shape of legs 16H1 and 16H2 runs adjacent and parallel to a corresponding reinforcing beam 24*b*. The deployment of one of the oblong shapes adjacent and parallel to the reinforcing beams ensures that there is a vertical load-bearing wall of the leg running along a significant length of the beam to provide support. Optionally, additional reinforcing ribs 26 (FIG. 1E) may be provided to distribute load between the adjacent wall of the leg and the reinforcing beam.

The selection of T-shape and H-shape legs according to a particularly preferred implementation of the present invention will now be understood. Where the leg is providing support for two reinforcing beams, it is preferably to have two oblong shapes, one running adjacent to each beam, thereby indicating that the H-shape leg will be most suited. Where the leg extends towards a side of the deck, it is preferable to employ a leg form which does not extend along the perimeter of the deck, so as to minimize the exposure of the leg to accidental impacts and consequent damage, indicating that the T-shape leg will be most suitable.

Figure 7:
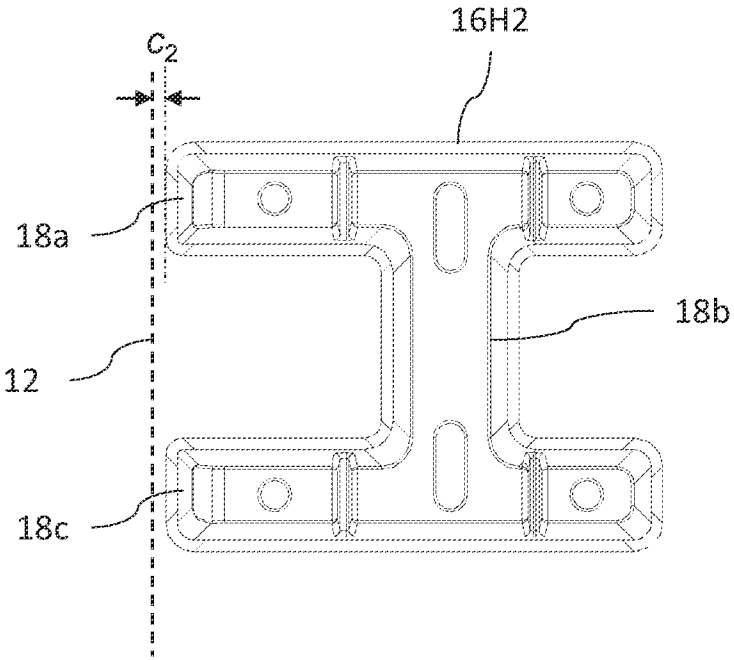
FIG. 7 is a schematic view of a further one of the legs illustrated in FIG. 3A corresponding to an asymmetric variant of the leg of FIG. 5A, illustrating its positioning relative to an end of the nestable pallet.
Figure 6:
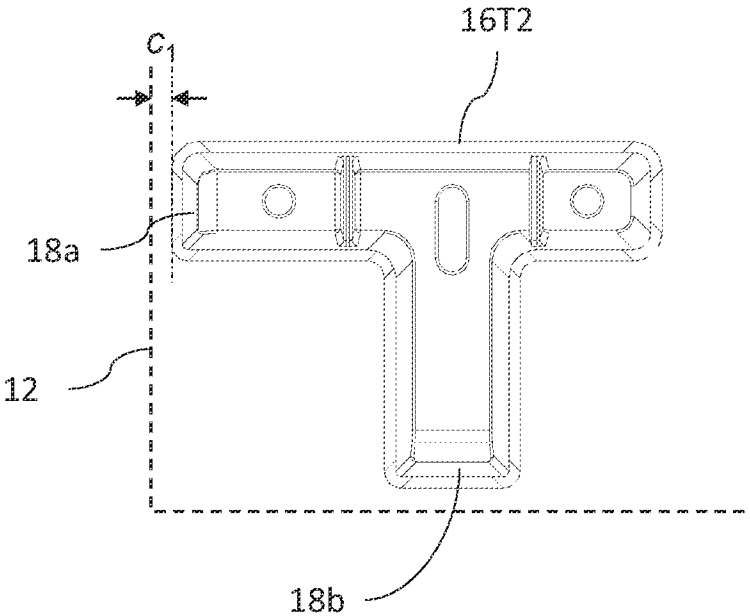
FIG. 6 is a schematic view of a further one of the legs illustrated in FIG. 3A corresponding to an asymmetric variant of the leg of FIG. 4A, illustrating its positioning relative to a corner of the nestable pallet.

In order to bring the support structures of the legs as close as possible to the ends (i.e., the short edges) of the pallet, which is particularly important for racking, while keeping the wall of the legs which extends parallel to the edge well set back away from the edge, asymmetric versions of both the T-shape leg and the H-shape leg may be implemented, as illustrated by leg 16T2 of FIGS. 6 and 16H2 of FIG. 7. In the case of leg 16T2, the top of the T-shape, corresponding to oblong shape 18*a* in FIG. 4A, is extended towards the end (short edge) of the deck. This effectively renders the leg set-back from the corner of the deck along both sides, as understood from the partial outline of the deck 12 as shown in dashed lines. Similarly in FIG. 7, asymmetric extension of the sides of the H-shape (corresponding to oblong shapes 18*a* and 18*c* in FIG. 5A) towards the end (short edge) of the deck 12 provides good mechanical support to the end of the pallet while minimizing exposure of the main part of the leg to impacts from the end of the pallet.

Figure 1C:
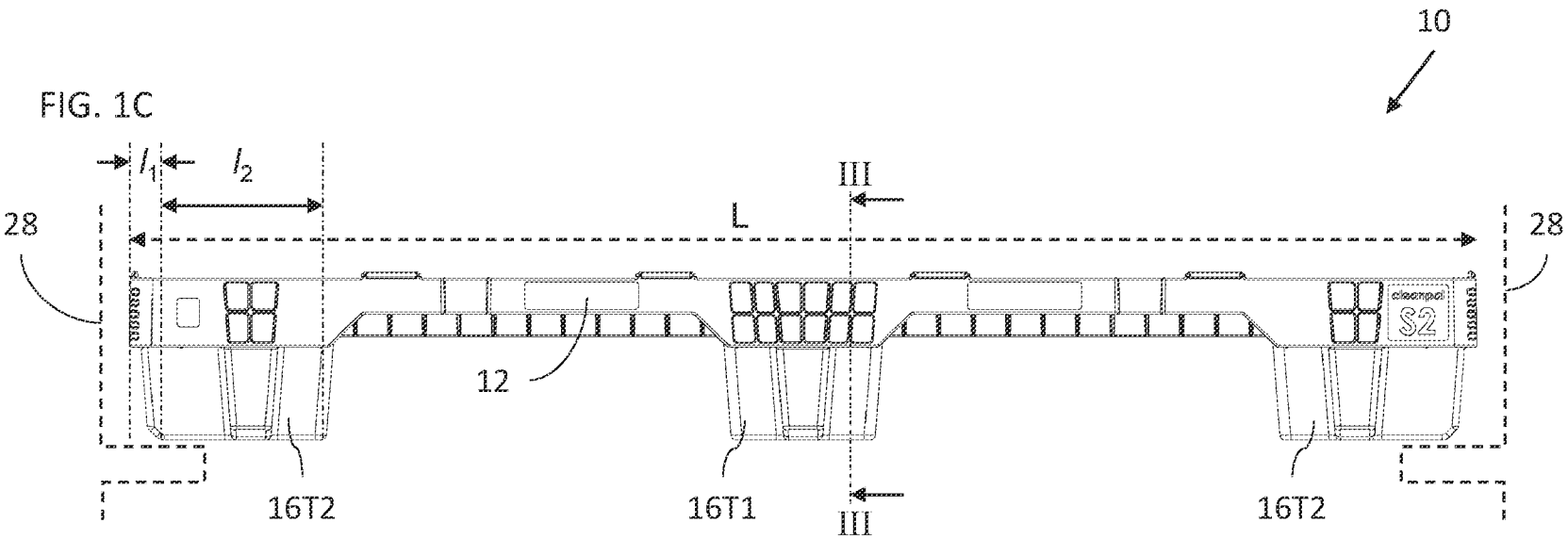
Figure 1D:
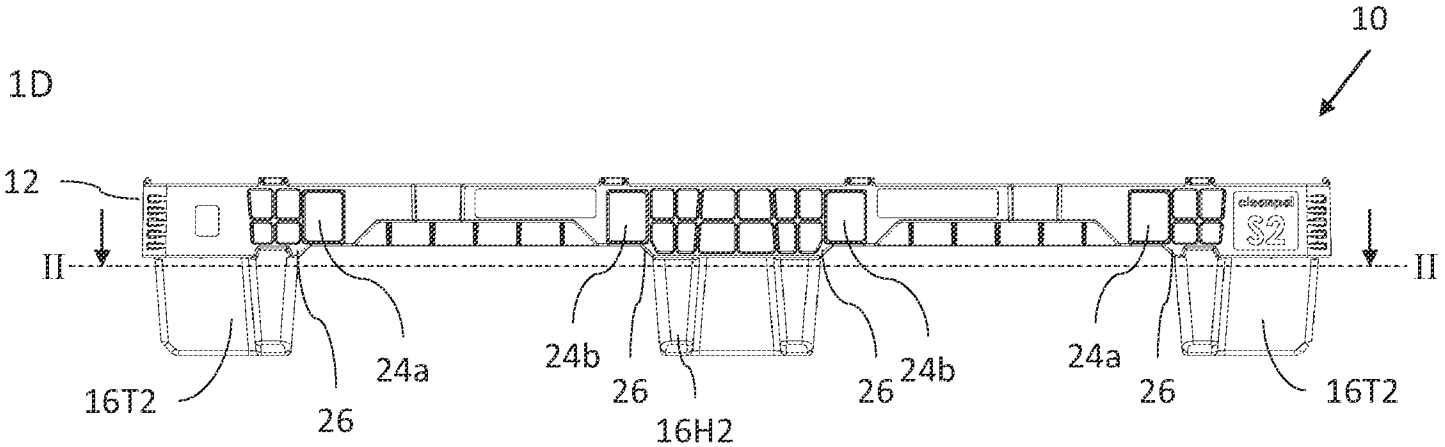
Figure 1E:
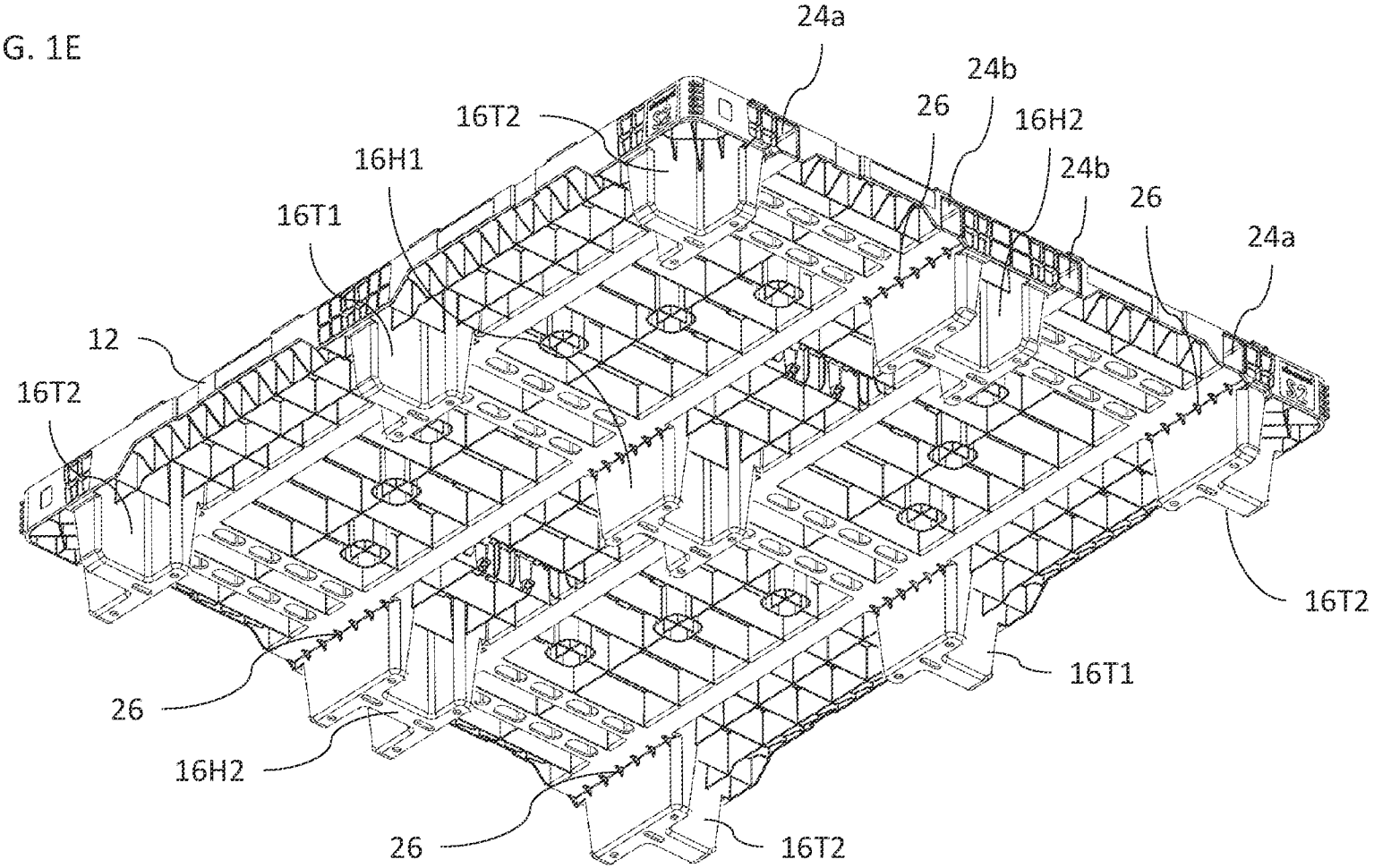
FIG. 1E is an isometric view of the underside of the nestable pallet of FIG. 1A.

As best seen in FIG. 1C, the above leg structures allow the legs to continue up to very close to the ends of the pallet. Specifically, the floor contact surface of the hollow legs preferably starts at a distance $l_1$ less than 3 percent of a length of the deck away from an end of the nestable pallet. This renders pallet 10 particularly suitable for storage in a racked storage system, as illustrated schematically by the dashed "rack" supports 28 in FIG. 1C. The "end" of the pallet for this purpose is taken to be a vertical plane extending downward from the extremity of deck 12. This proximity of the legs to the edges of the pallet may advantageously be provided along all edges of the pallet.

While maintaining the aforementioned proximity of the legs to the edges of the pallet, preferably for all of the legs adjacent to the pallet edges, there may advantageously be differences in proximity to the edges for the legs that are near the middle of the pallet edges and those near the corners. Specifically, as illustrated in FIGS. 6 and 7, a clearance spacing between the leg and the pallet edge for corner legs 16T2, labeled in FIG. 6 as $c_1$ is preferably larger than a clearance spacing $c_2$ between the legs 16T1 and 16H2 in a medial region of the sides of the pallet. (It should be noted that clearance spacings $c_1$ and $c_2$ are not identical to $l_1$ since $l_1$ refers to the distance of the floor contact surface from the pallet edge, which may be slightly larger than the distance to the upright portion of the leg.) The difference between $c_1$ and $c_2$ is preferably not more than a few millimeters, but may still provide enhanced protection for the more exposed corner legs from mechanical impacts often occurring during handling of pallets with forklifts.

In order to facilitate use of pallet 10 in automatic conveyors, and particularly roller conveyors, the floor contact surface of the hollow legs 16T2 and 16H2 adjacent to the ends of the pallet preferably each span a length $l_2$ (FIG. 1C) that is at least 10 percent of a length L of the deck.

Similarly, according to a further preferable feature, the floor contact surfaces of the hollow legs taken together span more than 30 percent of a length of the deck.

Although the invention has been illustrated in a particularly preferred implementation with 9 legs spread in a 3×3 configuration, it will be appreciated that the principles of the present invention may be applied to pallets of differing load bearing requirements and differing sizes and shapes. The number of legs, as well as the number of reinforcing beams, can be varied according to the design considerations of each particular application.

It will be appreciated that the above descriptions are intended only to serve as examples, and that many other embodiments are possible within the scope of the present invention as defined in the appended claims.

What is claimed is:

1. A nestable pallet for supporting a load above a floor comprising:

(a) a deck having an upper surface for bearing the load, a length and a width; and (b) a plurality of hollow legs integrally formed with said deck and extending downwards from said deck so as to support said deck above the floor, each of said hollow legs having an upper opening for receiving part of a corresponding leg of another pallet when a plurality of similar pallets are stacked, wherein a horizontal cross-sectional shape of at least one of said hollow legs corresponds to the union of at least two intersecting oblong shapes, each oblong shape having an aspect ratio greater than 2:1 between an extensional direction and a transverse dimension, and wherein said at least two intersecting oblong shapes intersect with their extensional directions orthogonal to each other such that a largest circle that can fit inside said horizontal cross-sectional shape has an area of less than 20 percent of an enclosing rectangle, where the enclosing rectangle is defined as a rectangle with sides parallel to said length and said width which fits closely to said horizontal cross-sectional shape.

2. The nestable pallet of claim 1, wherein each of said oblong shapes has its extensional directions running parallel to said length or said width.

3. The nestable pallet of claim 1, wherein said deck further comprises a set of reinforcing beams, and wherein one of said oblong shapes runs adjacent to, and with its extensional direction parallel to, a length of one of said reinforcing beams.

4. The nestable pallet of claim 3, wherein said at least one of said hollow legs is deployed between one of said reinforcing beams and an edge of said deck, and wherein said at least two oblong shapes form a T-shape horizontal cross-sectional shape with a top of said T-shape running adjacent and parallel to said reinforcing beam and a base of said T-shape extending towards the edge of said deck.

5. The nestable pallet of claim 4, wherein said T-shape is an asymmetric T-shape in which one side of the top of the T-shape extends towards another edge of said deck.

6. The nestable pallet of claim 3, wherein said at least one of said hollow legs is deployed between two of said reinforcing beams, and wherein said at least two oblong shapes are three oblong shapes forming an H-shape horizontal cross-sectional shape with each side of said H-shape running adjacent and parallel to a corresponding one of said two reinforcing beams.

7. The nestable pallet of claim 6, wherein said H-shape is an asymmetric H-shape in which the sides of the H-shape extend towards an edge of said deck.

8. The nestable pallet of claim 1, wherein a floor contact surface of said hollow leg starts less than 3 percent of said length of said deck away from an end of the nestable pallet.

9. The nestable pallet of claim 1, wherein a floor contact surface of said at least one of said hollow legs spans at least 10 percent of said length of said deck.

10. The nestable pallet of claim 1, wherein a floor contact surface of said plurality of hollow legs spans more than 30 percent of said length of said deck.

11. The nestable pallet of claim 1, wherein a first of said hollow legs is located in a corner region of said deck and a second of said hollow legs is located in a medial region of a side of said deck, said first hollow leg being spaced away from edges of said deck by a clearance distance greater than a clearance distance that said second hollow leg is spaced away from an edge of said deck.

12. A nestable pallet for supporting a load above a floor comprising:

(a) a deck having an upper surface for bearing the load, a length and a width, said deck including a plurality of reinforcing beams extending parallel to said length; and (b) a plurality of hollow legs integrally formed with said deck and extending downwards from said deck so as to support said deck above the floor, each of said hollow legs having an upper opening for receiving part of a corresponding leg of another pallet when a plurality of similar pallets are stacked, a first of said hollow legs having a horizontal cross-sectional shape corresponding to the union of two oblong shapes forming a T-shape horizontal cross-sectional shape, and deployed such that a top of said T-shape runs adjacent and parallel to one of said reinforcing beams and a base of said T-shape extends towards an edge of said deck, a second of said hollow legs having a horizontal cross-sectional shape corresponding to the union of three oblong shapes forming an H-shape horizontal cross-sectional shape with each side of said H-shape running adjacent and parallel to a corresponding one of said two reinforcing beams, and wherein a floor contact surface of said hollow leg starts less than 3 percent of said length of said deck away from an end of the nestable pallet.

13. A nestable pallet for supporting a load above a floor comprising:

(a) a deck having an upper surface for bearing the load, a length and a width, said deck including a plurality of reinforcing beams extending parallel to said length; and (b) a plurality of hollow legs integrally formed with said deck and extending downwards from said deck so as to support said deck above the floor, each of said hollow legs having an upper opening for receiving part of a corresponding leg of another pallet when a plurality of similar pallets are stacked, a first of said hollow legs having a horizontal cross-sectional shape corresponding to the union of two oblong shapes forming a T-shape horizontal cross-sectional shape, and deployed such that a top of said T-shape runs adjacent and parallel to one of said reinforcing beams and a base of said T-shape extends towards an edge of said deck, a second of said hollow legs having a horizontal cross-sectional shape corresponding to the union of three oblong shapes forming an H-shape horizontal cross-sectional shape with each side of said H-shape running adjacent and parallel to a corresponding one of said two reinforcing beams, and wherein, for each of said hollow legs, said horizontal cross-sectional shape has an enclosing rectangle defined by a rectangle with sides parallel to said length and said width which fits closely to said horizontal cross-sectional shape, and wherein a largest circle that can fit inside said horizontal cross-sectional shape has an area of less than 20 percent of said enclosing rectangle.

14. The nestable pallet of claim 13, wherein a floor contact surface of said hollow leg starts less than 3 percent of said length of said deck away from an end of the nestable pallet.

15. The nestable pallet of claim 12, wherein a floor contact surface of said at least one of said hollow legs spans at least 10 percent of said length of said deck.

16. The nestable pallet of claim 12, wherein a floor contact surface of said plurality of hollow legs spans more than 30 percent of said length of said deck.

17. The nestable pallet of claim 12, wherein said first hollow leg is located in a corner region of said deck and said second hollow leg is located in a medial region of a side of said deck, said first hollow leg being spaced away from edges of said deck by a clearance distance greater than a clearance distance than said second hollow leg is spaced away from an edge of said deck.

* * * * *